United States Patent [19]

Sampson

[11] 4,441,778

[45] Apr. 10, 1984

[54] PATCHCORD CONNECTOR

[75] Inventor: Stephen A. Sampson, Wheaton, Ill.

[73] Assignee: Allied Corporation, Morris Township, Morris County, N.J.

[21] Appl. No.: 309,900

[22] Filed: Oct. 9, 1981

Related U.S. Application Data

[63] Continuation of Ser. No. 93,401, Nov. 13, 1979, abandoned.

[51] Int. Cl.[3] ..... H01R 13/39

[52] U.S. Cl. ..... 339/99 R; 339/103 M; 339/107

[58] Field of Search ..... 339/97 R, 97 P, 98, 339/99 R, 103 M, 107

[56] References Cited

U.S. PATENT DOCUMENTS

| | | | |
|---|---|---|---|
| 2,359,541 | 10/1944 | Bancroft | 339/97 R |
| 2,584,476 | 2/1952 | Liaci | 339/97 R |
| 3,388,367 | 6/1968 | Brown | 339/97 P |
| 3,868,161 | 2/1975 | Frantz | 339/97 R |
| 3,899,236 | 8/1975 | Santos | 339/98 |
| 3,910,672 | 10/1975 | Frantz | 339/97 P |
| 4,138,184 | 2/1979 | Knopp | 339/97 P |
| 4,160,575 | 7/1979 | Schraut | 339/103 M |
| 4,165,145 | 8/1979 | Steinbach | 339/103 M |

FOREIGN PATENT DOCUMENTS

| | | | |
|---|---|---|---|
| 2906031 | 8/1979 | Fed. Rep. of Germany | 339/98 |

*Primary Examiner*—Joseph H. McGlynn

*Attorney, Agent, or Firm*—James P. DeClercq; Barry W. Sufrin

[57] ABSTRACT

A patchcord connector with contact members mounted within an enclosed housing and driving means operable from outside of the housing for independently terminating conductors to each contact.

15 Claims, 15 Drawing Figures

4
14
16
18
19
19A
19B
132
134
112
113
114
116
122
120
124
126
20
10
40
41
42
44
46
48
12
28
22
78
74
26
25
62
24
23
60
52
30
35
37
34

14
16
13
20
36
18
21
6
10
24
30

PATCHCORD CONNECTOR

This is a continuation of application Ser. No. 93,401, filed Nov. 13, 1979, now abandoned.

BACKGROUND OF THE INVENTION

This invention relates generally to electrical connectors and more particularly to patchcord connectors for terminating one or more insulated conductors and electrically interconnecting the conductors to a terminal board or other electrical component. In one important embodiment, the present invention relates to an improved patchcord connector for multi-conductor electrical cables having means for independently terminating individual conductors and also including separate strain relief means for each conductor and a strain relief for the entire cable.

In data processing and in communication systems, and particularly in telephone communication systems, it is necessary to be able to rapidly connect and disconnect particular lines with other selected lines or series of lines through a terminal or patch board. Patchcords designed for this purpose are used, for example, in telephone exchanges and telephone central offices. They are also used in office and apartment buildings where large numbers of incoming lines must be interconnected with inside telephone lines.

These patchcords are conveniently terminated at one or both ends with connectors which must exhibit a high degree of reliability, particularly in view of the numerous mating cycles encountered in their use. Accordingly, patchcord connectors should be ruggedly constructed and designed with adequate strain relief to prevent disengagement of the conductors should the patchcord be pulled or tugged during mating of the connector.

In addition to being reliable, it is also important that patchcord connectors be simple in construction and easy to assemble in the field. Prior patchcord connector designs have attempted to meet these field assembly requirements by utilizing such refinements as two piece assembly, partial pre-assembly, and insulation piercing contacts. It has been found, however, that in spite of the putative advantages inherent in each of these prior refinements, in practice they have suffered significant shortcomings.

For example, in two-piece connectors it has been found to be awkward and time-consuming to hold conductors in place while the two connector pieces are assembled. Even where means are provided for gripping the individual conductors within one of the connector parts prior to assembly, the manipulation of the two connector parts nevertheless presents unnecessary complication in the field.

Particularly pre-assembled patchcord connectors, on the other hand, have in the past been complex to make and to use. These prior connectors generally have required the use of special tools for terminating the conductors within the connector.

Although the introduction of insulation piercing contacts in general is a most important development since it eliminates the need for soldering, the use of these contacts in patchcord connectors has presented certain drawbacks. These contacts generally require very precise positioning of contacts and corresponding conductors prior to termination; the application of termination force, similarly, must be very carefully and precisely made. This sort of precision is difficult to achieve in the field. Contact distortion problems arise in the most common field terminable connector designs where the insulated conductor is held in place and the contact moved against it. Contacts designed to be moved during termination in this way must be specially reinforced to prevent such distortion.

When used with multiple conductors, prior patchcord connectors have generally required that all conductors be terminated at one time. This presents handling difficulties in the field. Furthermore, where each conductor cannot be separately handled and terminated, uncertainty arises as to whether all of the conductors have been properly terminated. In addition, in these prior bulk termination connectors, it is not possible to add, or to remove, a single conductor after initial assembly and termination is complete.

Finally, prior patchcord connectors have often provided inadequate strain relief, especially in the case of multiple conductor connectors. Prior connectors have failed to offer separate strain relief for the individual conductors and for the multiple conductor cable itself.

It is therefore the object of the present invention to provide an improved patchcord connector which overcomes the above-mentioned deficiencies of the prior art. As described in further detail below, the patchcord connectors described herein are of simple, rugged construction and are readily pre-assembled for later use in the field. The connectors are each capable of independently terminating a number of separate insulated conductors, and they include separate strain relief means for each individual conductor as well as for the multi-conductor patchcord itself.

SUMMARY OF THE INVENTION

The present invention is directed to a patchcord connector for terminating at least one insulated conductor. The connector includes a housing having at least one elongated pocket with an access opening in communication with the exterior of the housing. The pocket and the access opening are dimensioned to accept the insulated conductor.

The connector also includes at least one contact element with a termination portion disposed within the elongated pocket. The termination portion includes means for piercing the insulation of the insulated conductor.

In addition, the present patchcord connector has means associated with the housing for driving the insulated conductor into the piercing means, to establish electrical connection between the contact element and the conductor. The driving means is operable from a point outside of the connector housing.

In a preferred form, the present patchcord connector consists of first and second interlockable body members. At least one of the body members carries an elongated groove along the surface adjoining the two members when they are interlocked to define the elongated pocket. The interlockable body members may be joined along a corresponding edge by integrally formed unitary hinge.

The contact termination portion employed in the present invention optimally includes positioning means in the form of an aperture in communication with the piercing means. This aperture which is large enough to freely accept the insulated conductor is positioned for locating the insulated conductor adjacent the piercing means.

The driving means employed in the present invention may be mounted in an aperture in the connector housing overlying the piercing means. Typical driving means include a push button mounted for movement between a pre-termination position and a termination position. With the push button in its pre-termination position, the driving means is separated from the insulated conductor. Movement of the push button to its termination position will move the driving means into abutment with the insulated conductor into electrical connection with the contact element. The push button, when in its pre-termination position, may be frangibly mounted in the aperture overlying the piercing means. Alternatively, it may be hinged to an edge of the housing aperture.

Strain relief means for the insulated conductor is provided by positioning a relief recess coincident with the piercing means to permit a portion of the conductor engaged by the driving means to be depressed thereinto. Enhanced strain relief is obtained by restraining the conductor in the space between a projecting edge adjacent the relief recess and the driving means, in its depressed position.

The piercing means and the driving means cooperate in terminating the insulated conductor. In one important embodiment, the piercing means is generally planar and the driving means is mounted for face-to-face movement with respect thereto. The driving means may include portions with generally parallel planar surfaces defining a slot so that the driving means may move with these parallel portions astride the piercing means.

Where multiple conductors are to be terminated in the connector, the patchcord connector will include means for independently driving each insulated conductor into the piercing means of a respective contact element termination portion. In this multiple conductor case it is preferred that the patchcord connector contain a separate strain relief for the cable itself.

The various features and advantages of the present invention will become apparent upon examination of the following specification and drawings, taken together with the claims. While the invention is described below in connection with preferred or illustrative embodiments, these embodiments are not intended to be exhaustive or limiting of the invention. Rather the invention is intended to cover any alternatives, modifications and equivalents that may be included within its spirit and scope, as defined by the appended claims.

BRIEF DESCRIPTION OF THE DRAWING

The invention, together with further of its objects and attendant advantages, will best be understood by reference to the following description taken in connection with the accompanying drawings in which.

DETAILED DESCRIPTION OF THE PREFERRED EMBODIMENT

Figure 2:
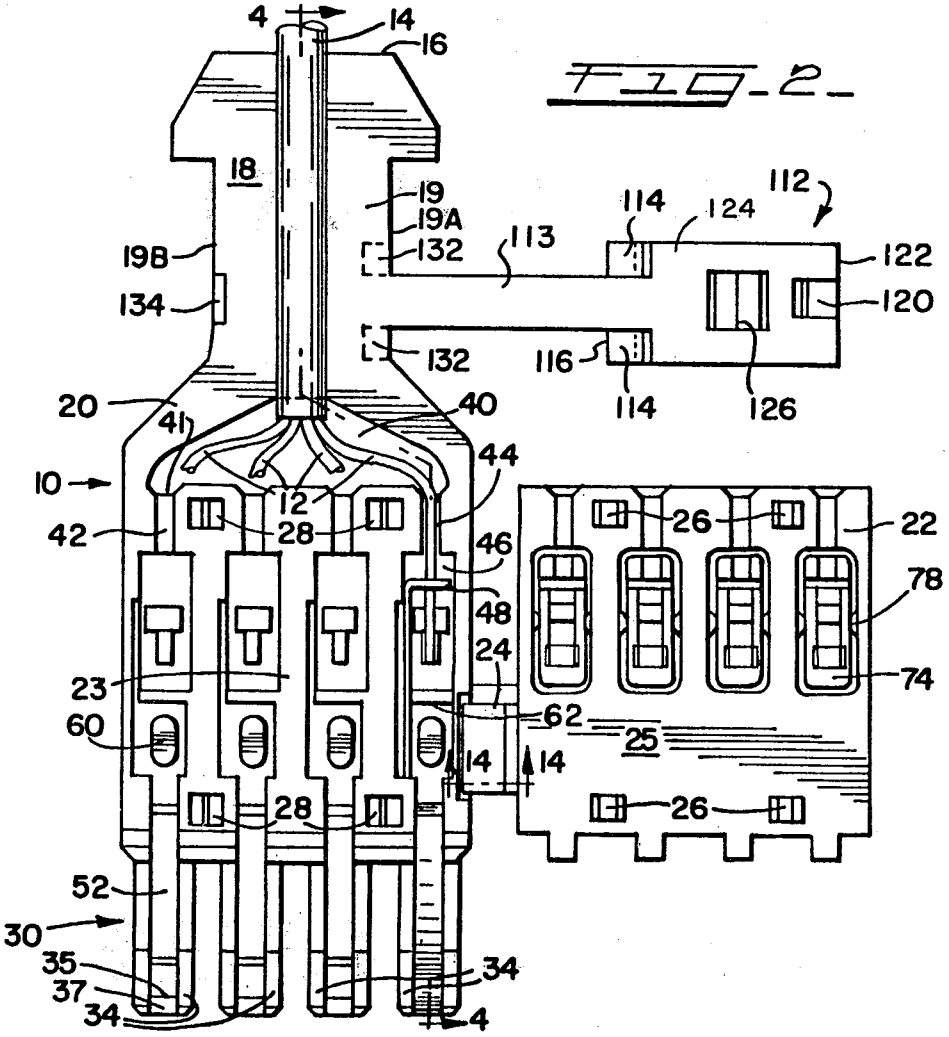
FIG. 2 is a top plan view of a patchcord connector according to the present invention, in an open, unassembled position and illustrating the interior construction of the connector housing.
Figure 1:
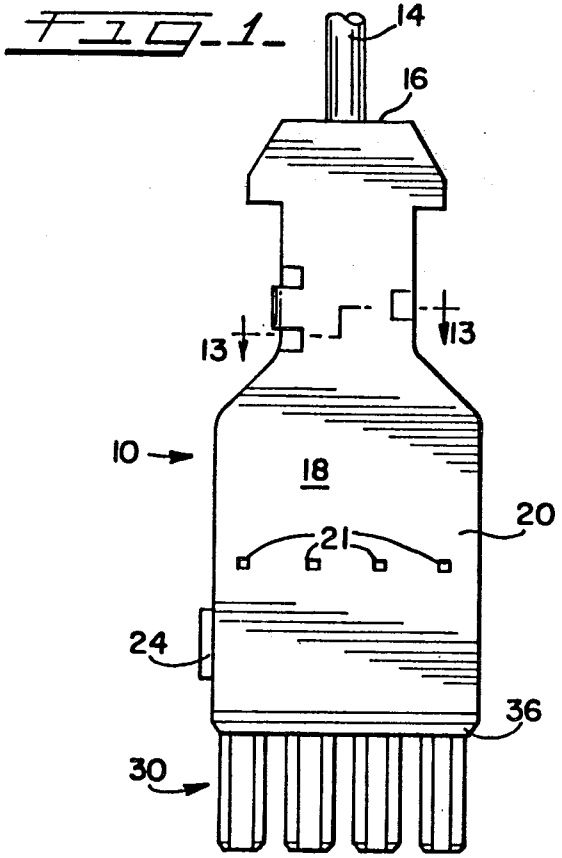
FIG. 1 is a bottom plan view of a fully assembled patchcord connector constructed in accordance with the present invention.
Figure 3:
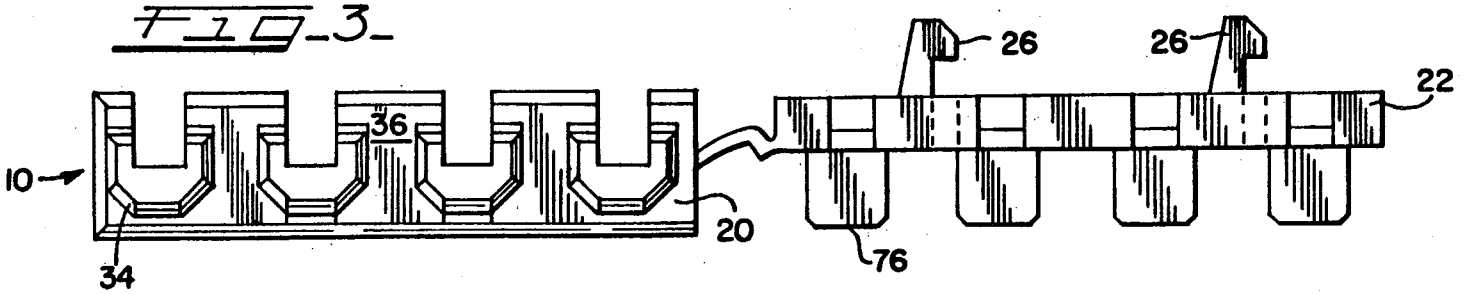
FIG. 3 is an enlarged and elevation view of the connector of FIG. 2.

Referring first to FIGS. 1 and 2, a patchcord connector 10 is shown, having a plurality of insulated conductors 12 terminated therein. In order to improve the clarity of the figures, actual termination in an individual contact is shown for only one of the conductors 12 (FIG. 2). The insulated conductors 12 together comprise a multiple conductor cable 14, which is illustrated emerging from the rear end 16 of the connector housing 18.

The connector housing may be formed from any suitable dielectric material. Preferably, it will be constructed from a generally rigid plastic material using conventional molding techniques. Use of a clear material will enhance the practical value of the present invention by facilitating inspection of the internal condition of the connector, including conductors and contacts.

Figure 14:
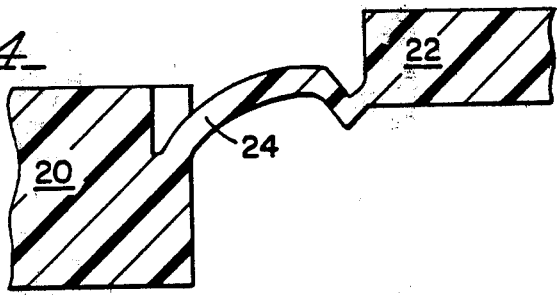
FIG. 14 is a fragmentary cross-sectional view of the integrally formed unitary hinge of the present invention taken along line 14—14 of FIG. 2.
Figure 15:
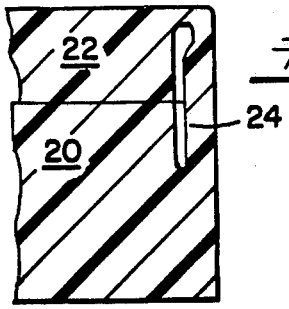
FIG. 15 is a cross-sectional view of the hinge of FIG. 14 with first and second interlockable body members of the present invention in closed, interlocked position.

The housing 18 includes first and second interlockable body members in the form of base 20 and cover 22. Base 20 and cover 22 may be interlocked by means of cover latches 26 which engage in latch acceptance apertures 28. Base 20 and cover 22 are hingedly secured together by integral living hinge 24. Hinge 24 is illustrated in its open and closed positions in FIGS. 14 and 15 respectively.

Base member 20 includes plug portion 30 with leg members 34 corresponding in number to the number of conductors 12 to be terminated within the connector 10. Each leg member 34 projects outwardly from the front 36 of the housing 18 for engagement with mating receptacles on a terminal or patch board. The bottom 20, as illustrated, includes molding access holes 21 which may accept test probes for checking electrical continuity within the connector.

The bottom portion 20 of the housing 18 includes recess 38 (FIG. 4) for positively centering cable 14. Recess 38 extends from end 16 to radiating recess 40 in which the individual insulated conductors 12 may be separated for termination. Radiating recess 40 communicates with access slots 41 and elongated channels 42 which extend to the terminal ends 35 of their respective plug portion leg members 34. Assembly of the connector by joining cover 22 to base 20 along their respective opposing faces 25 and 23 will enclose access slots 41 and elongated channels 42 to transform them respectively to access openings in communication with the exterior of housing 18 and enclosed recesses or elongated pockets. These pockets may be filled with silicone grease during assembly of the connector 10 to obtain enhanced environmental sealing. Channels 42 include a wire receiving portion 44 and a contact element receiving portion 46.

Figure 6:
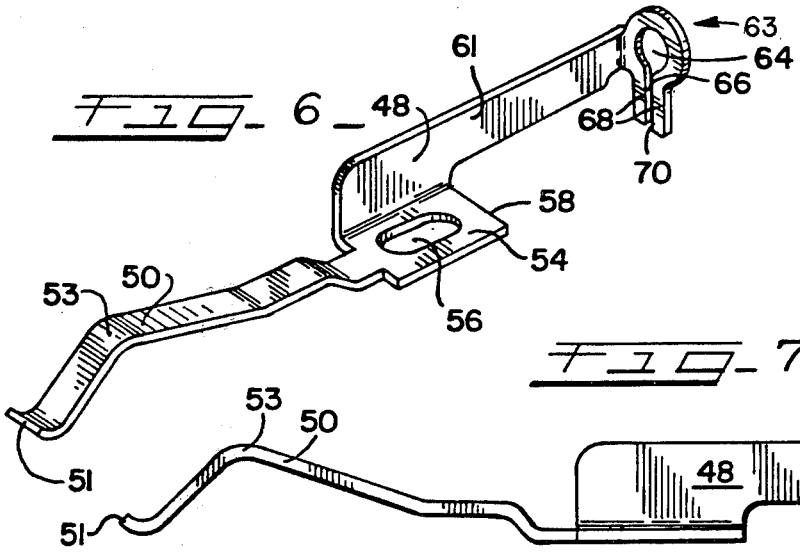
FIG. 6 is an enlarged perspective view of a contact element utilized in the present patchcord connector.
Figure 7:
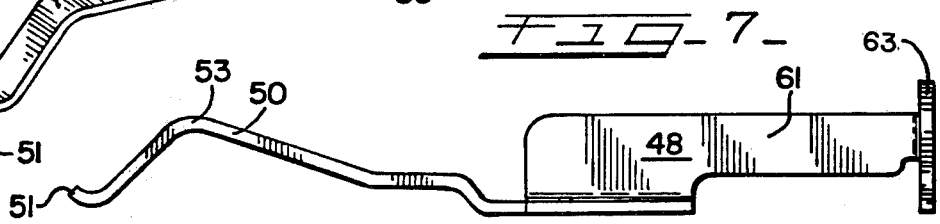
FIG. 7 is a front elevation view of the contact of FIG. 6.
Figure 8:
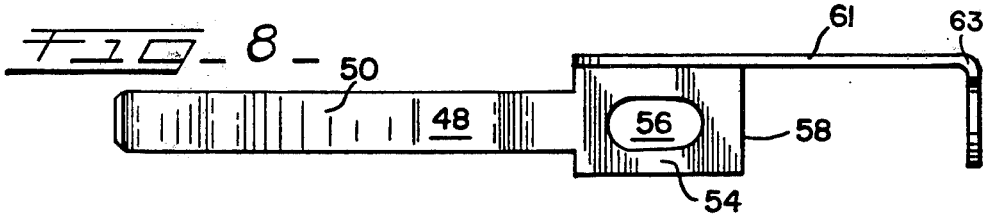
FIG. 8 is a top plan view of the contact of FIGS. 6 and 7.

Contact elements 48, which are best illustrated in FIGS. 6–8, are designed to be press-fitted within the contact receiving portion 46 of elongated channels 42. Each contact element 48 includes an active portion 50 for positioning within the mating channel 52 of a plug portion leg member 34. Active portion 50 of contact 48 includes a bowed section 53 for engaging the active portion of a corresponding contact member mounted in a terminal or patching board. The active contact portion 50 also includes an end 51 designed to abut a shoulder member 37 disposed adjacent the end of mating channel 52 of plug leg member 34 to prevent the contact element tip from being cracked during insertion of the contact 10 into a terminal board.

Contact elements 48 also include a planar intermediate portion 54, elongated aperture 56 and forward edge 58.

Figure 4:
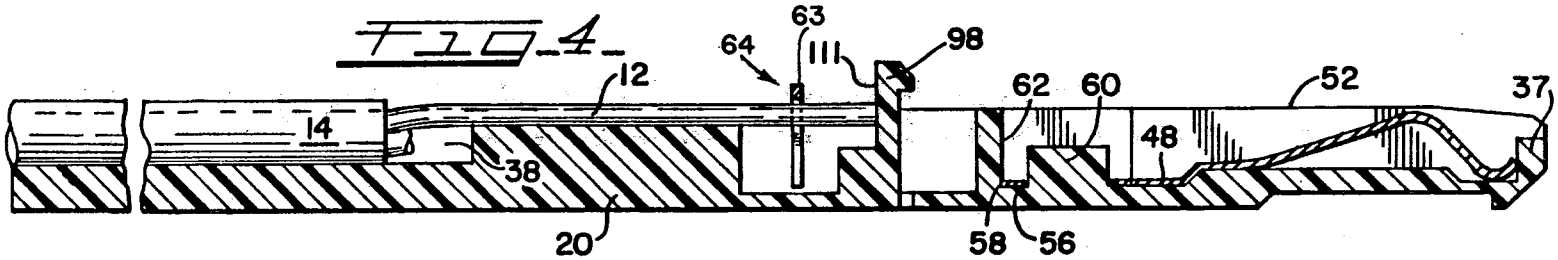
FIG. 4 is an enlarged, cross-sectional view taken along line 4—4 of FIG. 2.
Figure 5:
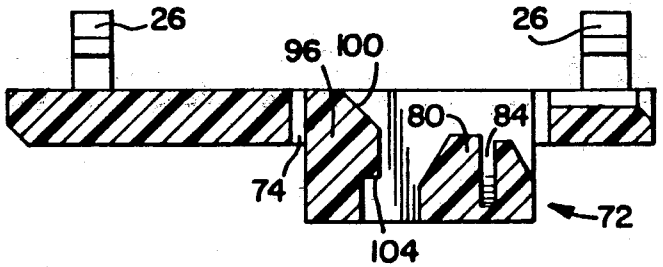
FIG. 5 is an enlarged, cross-sectional view of driving means utilized in the invention.

Contact elements 48 are preferably press-fitted within contact element receiving portions 46 of elongated channels 42 and held in proper orientation within the channels by means of integral elongated lugs 60 and integral channel stop 62. This is best illustrated in FIGS. 2 and 4 where integral elongated lug 60 is shown in engagement with contact elongated aperture 56 and contact leading edge 58 is shown in abutment with channel stop 62.

Contact elements 48 include arm portions 61 oriented generally perpendicularly to intermediate portions 54. Arm portions 61 carry termination portions 63 which in turn lie in a plane generally perpendicular to both arm portions 61 and intermediate portions 54. An open keyhole aperture including generally circular opening 64 and communicating slot 66 is located in termination portion 63 of each contact element 48. Opening 64 acts as a positioning means for positioning an insulated conductor 12 adjacent slot 66 which is designed to act as an insulation piercing means, as discussed further below. Opening 64 must be of a size sufficient to accommodate insulated conductor 12.

Conventional insulation piercing means of various different types may be used in the present invention. In the embodiment depicted in the drawings, the insulaton piercing means includes slot 66 defined by legs 68 with edges 70 spaced at a distance less than the diameter of the conductor portion (not shown) of insulated conductors 12. Edges 70 include means for cutting through the insulation of insulated conductor 12 and biting into the conductive portion to establish electrical contact.

The present patchcord connector 10 may be readily formed or manufactured and pre-assembled, prior to use in the field for terminating insulated conductors 12. The structural layout of the connector housing 14 in a single piece facilitates injection molding without side movement of the mold—all molding is done by up and down movement. Pre-assembly then entails the press-fitting of contact elements 48 in the appropriate locations in channels 42 and the interlocking of housing top 22 to bottom 20 by means of latches 26 and catches 28, as described earlier. When these pre-assembled connectors are received in the field, they then may be used to terminate individual conductors 12 of a multiple conductor cable 14, through the cooperation of termination portions 63 discussed above, and driving means 72, which will be described below.

A driving means for terminating conductors 12 by driving the conductors from opening 64 and into slot 66 is illustrated in FIGS. 5 and 9–12. Driving means 72 are mounted in apertures 74 of cover 22. In the pre-assembled patchcord connector, these apertures overlie termination portions 63. Driving means 72 includes operating means in the form of push button 76 which is disposed within aperture 74 for operation from a point outside of housing 18.

Figure 9:
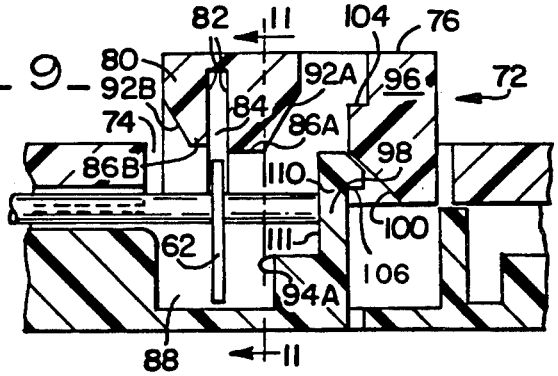
FIG. 9 is an enlarged fragmentary elevation view of a push button of the present invention in its pre-termination position with driving means separated from an insulated conductor positioned for termination.
Figure 10:
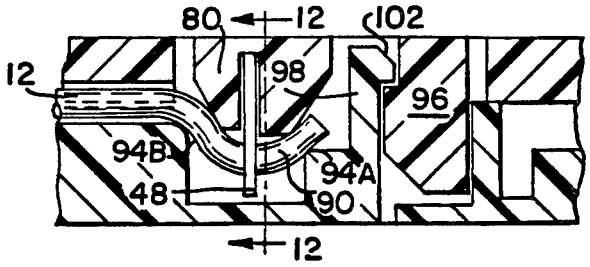
FIG. 10 is an enlarged fragmentary elevation view of a push button of the present invention in its termination position with the conductor in electrical connection with the contact element and the driving means abutting the insulated connector.
Figure 11:
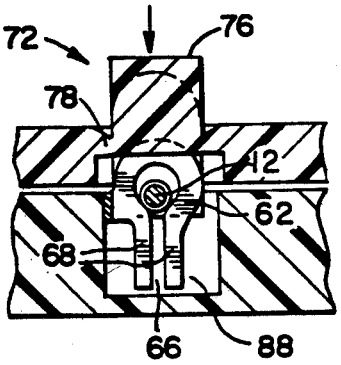
FIG. 11 is a cross-sectional view taken along line 11—11 of FIG. 9.
Figure 12:
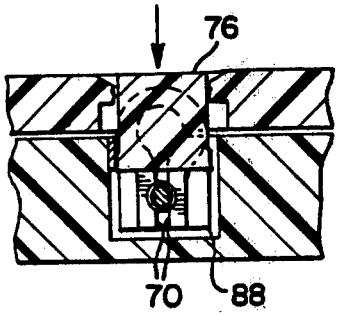
FIG. 12 is a cross-sectional view taken along line 12—12 of FIG. 10.

Push button 76 is mounted in aperture 74 for movement between the pre-termination position depicted in FIG. 9 and the termination position depicted in FIG. 10. In its pre-terminaton position, push button 72 may be fixed within the aperture by a living hinge or by other conventional means. In the preferred embodiment illustrated in the present Figures, push button 74 is frangibly mounted in aperture 74 by means of break away portions 78.

Driving means 72 includes projecting portion 80 which is positioned in the assembled connector for face-to-face movement with respect to termination portions 63 as push button 76 moves from its pre-termination (FIG. 9) to its termination position (FIG. 10). Projecting portion 80 includes generally planar parallel surfaces 82 defining a slot 84 of width slightly greater than the thickness of termination portions 63. As push button 76 is moved from its pre-termination position to its termination position, parallel surfaces 82 will move astride termination portions 63.

Nose portions 86 and 87 of driving means 72, which are separated from insulative conductor 12 prior to termination (FIG. 9) will move into abutment with insulated conductor 12 to drive the conductor into piercing means slot 66 (FIGS. 10 and 11) thereby establishing electrical connection between the conductor portion (not shown) of the insulated conductor 12 and contact element 48.

In addition to terminating insulated conductors 12, driving means 72 provides positive strain relief for the terminated conductor. This strain relief is accomplished through the cooperation of relief recess 88 which is coincident with contact piercing means 62. As the projecting portion 80 of driving means 72 drives insulated conductor 12 into slot 66, it will depress a portion 90 of conductor 12 into relief recess 88 to obtain a measure of strain relief. In addition, bevelled faces 92A and 92B of nose portions 86A and 86B will further constrain conductor portion 90 against respective projecting edges 94A and 94B of relief recess 88 to obtain a more positive strain relief.

A positive indication that a particular conductor has been fully terminated and that strain relief of that conductor has been accomplished is provided by push button locking means consisting of latches 96 and 98 with respective bevelled faces 100 and 102 and respective mating lips 104 and 106. As can be seen from the width of the respective neck portions 108 and 110 of latches 96 and 98, latch 98, which is integral with elongated channel 42, is far less massive and therefore more flexible than latch 96. When push button 76 is in its pre-termination position, frangibly attached to aperture 74, bevelled faces 100 and 102 face each other. As push button 76 is moved towards its termination position, neck 110 of latch 98 flexes to permit bevelled faces 100 and 102 to bypass one another. When push button 76 reaches its termination position, neck 110 snaps back as mating lips 104 and 106 come into abutment. This snapping action generally results in an audible "click" indicating that push button 76 is locked in its termination position and that electrical connection and strain relief have been accomplished. Push button 76 may be released and removed, if necessary, by inserting a tool to move latch 98 out of the way.

Figure 13:
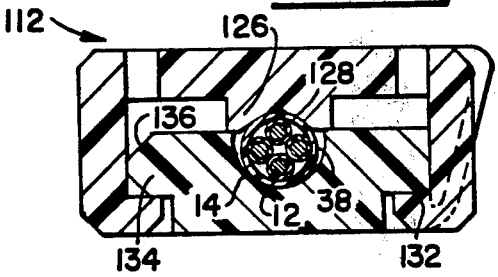
FIG. 13 is an enlarged cross-sectional view taken along line 13—13 of FIG. 1.

Patchcord connector 10 includes a cable strain relief 112 to limit relative movement between multiconductor cable 14 and the connector housing 18. The strain relief 112, which is depicted in its closed position in FIG. 13, is attached to the neck portion 19 of housing bottom 20 by an integral strap hinge 113. Strain relief 112 includes two latches 114 along strain relief inner edge 116 and a third latch 120 along the opposite edge 122 of the strain relief 112. Centered on the face 124 of strain relief 112 is a bifurcated jaw 126 with longitudinal groove 128 of generally triangular cross-section. Latches 114 and 120 are flexible and separated by a distance corresponding to the width of neck portion 19. Opposite edges 19A and 19B of neck portion 19 carry catches 132 and catch 134 for mating with corresponding latches 114 and 120. Cable 14 is fixed in place relative to connector 10 by positioning it in centering recess 38 and then hooking latches 114 with respective catches 132. Latch 120 of strain relief 112 is then forced down against leading bevelled edge 136 of catch 134 causing catch 120 to flex out and ride along the outer surface of catch 134 finally snapping back to its original position to lock strain relief 112 in place. With all latches in place, bifurcated jaw 126 will cooperate with centering recess 38 to limit the relative movement between cable 14 and connector 10.

The present patchcord connector may be used to terminate the individual insulated conductors of a multiple conductor cable as follows:

The multiple conductor cable 14 is first stripped in order to expose the separate insulated conductors contained therein. The cable 14 is then positioned in centering recess 38 and fixed in place by cable strain relief 112. With relative movement between cable 14 and connector thus limited, the individual insulated conductors 12 are inserted through access slots 41 and into the pockets formed from elongated channels 42. A positive stop to insure that a sufficient length of insulated conductor 14 is inserted is provided by the rearward surface 111 of latch 98. Once each of the insulated conductors 12 is in place in the desired elongated pockets, finger pressure is applied to push buttons 76 to break them away from their pre-termination position and to move them into their termination position. An audible "click" is heard as well as felt for each button to indicate that termination and independent strain relief of the corresponding insulated conductor has been completed.

As can be seen from the above description, the present invention provides for the straightforward termination of insulated conductors in a patchcord connector. Independent termination of individual conductors may be accomplished by this invention to obtain positive termination and strain relief of each individual conductor. Since termination means are stationary within the connector, the criticality of the positioning of the termination means and the need for reinforcement are reduced or eliminated. Finally, separate strain relief is provided for the multiconductor cable and for each individual insulated conductor.

It will be understood that the invention may be embodied in other specific forms without departing from the spirit or central characteristics thereof. The present examples and embodiments are to be considered as being illustrative and not as being restrictive, and the invention is not to be limited to the details herein but may be modified within the scope of the appended claims.

I claim:

1. A patchcord connector for terminating at least one insulated conductor, comprising:

a housing comprising body members interlocked to form a closed body, said closed body defining at least one internal pocket with an access opening in communication with the exterior of said housing, said access opening being dimensioned to permit unimpeded insertion of a portion of said insulated conductor into said pocket;

at least one contact element mounted within said housing before said body members are interlocked to form said closed body, said contact element having a termination portion disposed within said pocket, said termination portion including means for piercing the insulation of an insulated conductor inserted into said pocket of said closed body, said contact element termination portion including means for locating said insulated conductor adjacent said piercing means; and means associated with said closed body for driving a portion of said inserted insulated conductor into said piercing means to establish electrical connection between said contact element and said conductor without displacing said contact element, said driving means being operable from a point outside of said housing;

said housing consisting of first and second interlockable body members, at least one of said body members having a channel defining said pocket at the interface of said body members;

said positioning means of said termination portion of said contact element includes portions defining an aperture in communication with said piercing means, said aperture being of size sufficient to accommodate said insulated conductor, and adapted to receive a portion of said insulated conductor therethrough, said portion of said insulated conductor being driven from said aperture to said piercing means by said driving means;

said piercing means including means defining a slot with edges spaced at a distance less than the diameter of said conductor, said edges including means for cutting through said insulation and biting into said conductor;

said housing including an aperture overlying said piercing means and said driving means includes operating means mounted in said overlying aperture;

said operating means comprising a push button mounted for movement between a pre-termination position with said driving means separated from said insulated conductor, and a termination position with said conductor in electrical engagement with said contact element and said driving means abutting said insulated conductor;

said push button when in its pre-termination position being frangibly mounted in said aperture.

2. A patchcord connector as in claim 1 wherein said first and second body members are joined for relative movement along a corresponding edge by an integrally formed hinge.

3. A patchcord connector as in claim 1 including means for positively locking said push button in said termination position.

4. A patchcord connector as in claim 1 wherein said piercing means is generally planar and said driving means includes a projecting portion mounted for face-to-face movement with respect to said piercing means to drive said insulated conductor into said piercing means.

5. A patchcord connector as in claim 4 wherein said driving means includes opposing portions with generally parallel planar surfaces defining a slot, said driving means being mounted for movement with said parallel portions astride said piercing means.

6. A patchcord connector as in claim 1 wherein said pocket includes a relief recess coincident with said piercing means, said relief recess accepting a portion of said conductor as said conductor is terminated in said termination portion of said contact element to afford strain relief to said conductor.

7. A patchcord connector as in claim 6 wherein said relief recess includes at least one projecting edge cooperating with said driving means to mechanically restrain said conductor.

8. A patchcord connector for terminating a plurality of insulated conductors, comprising:

a housing comprising body members interlocked to form a closed body for receiving the insulated conductors, said closed body defining a plurality of internal elongated pockets with access openings in communication with the exterior of said housing, said access openings being dimensioned to permit unimpeded insertion of a portion of each of the insulated conductors into said pockets;

a plurality of contact elements mounted within said closed body, said contact elements having termination portions respectively disposed within said elongated pockets, said termination portions including means for piercing the insulation of conductors inserted into said pockets of said closed body, said contact element termination portions including means for locating said insulated conductors adjacent said piercing means;

said means for locating said insulated conductors including an aperture in each said termination portion in communication with said piercing means of said termination portion adapted to receive a portion of said insulated conductor therethrough;

means operable from the exterior of said closed body for independently driving said portion of each inserted insulated conductor into a respective one of said piercing means to establish electrical connection between each contact element and a respective conductor;

said housing consisting of first and second interlockable body members, at least one of said body members having channels defining said pockets at the interface of said body members;

said piercing means including means defining slots with edges spaced at a distance less than the diameter of said conductors, said edges including means for cutting through said insulation and biting into said conductors.

9. A patchcord connector as in claim 8 wherein said housing consists of first and second interlockable body members, at least one of said body members having channels defining said pockets at the interface of said body members.

10. A patchcord connector as in claim 8 wherein said housing includes apertures overlying said piercing means and said driving means include operating means mounted in said overlying apertures.

11. A patchcord connector as in claim 8 wherein said piercing means are generally planar and said driving means are mounted for face-to-face movement with respect to said piercing means.

12. The patchcord connector of claim 11 wherein said insulated conductors comprise a multiconductor cable and said housing includes a cable strain relief element for limiting the relative movement betweeen said cable and said connector.

13. In a patchcord connector for terminating a plurality of insulated conductors of the type having a housing with the plurality of elongated pockets in communication with the exterior of the housing and a plurality of contact elements having termination portions respectively disposed within the elongated pockets, the termination portions including means for piercing the insulation of said conductors, the improvement comprising:

means operable from a point outside of said housing for independently driving each said insulated conductor into a respective one of said piercing means to establish electrical connection between each of said contact elements and a respective conductor; and means associated with said contact elements for locating said insulated conductors adjacent said piercing means;

said means for locating said insulated conductors including an aperture defined in said contact element in communication with said piercing means for receiving said insulated conductor therethrough.

14. A patchcord connector for terminating a plurality of insulated conductors of a multi-conductor cable, comprising:

a housing including first and second interlocked members and having a plurality of internal elongated pockets with access openings in communication with the exterior of said housing, said access housing being dimensioned to permit unimpeded insertion of a portion of each of the insulated conductors into said pockets;

a plurality of contact elements mounted within said housing, said contact elements having termination portions respectively disposed within said elongated pockets, said termination portions including means for piercing the insulation of said conductors, said termination portions further including positioning means for locating said insulated conductors adjacent said piercing means;

said positioning means including an aperture in each said termination portion in communication with said piercing means;

means operable from a point outside of said housing for independently driving insulated conductors inserted into pockets from one said aperture in said termination portion into respective piercing means to establish electrical connection between each contact element and a respective conductor, said driving means including operating means overlying said piercing means in the form of a push button, said push button being mounted for movement between a pre-termination portion with said driving means separated from a respective insulated conductor, and a termination position with said respective conductor in electrical connection with said contact element and said driving means in abutment therewith;

conductor strain relief means cooperating with said driving means for mechanically retaining said conductor in terminated position within said pocket; and cable strain relief means, operable independently of said conductor strain relief means, for preventing said cable from moving with respect to said conductor.

15. An electrical connector for assembly to one or more electrical conductors comprising:

a dielectric housing comprising interlocked body members defining at least one internal pocket and with an access opening in communication with the exterior of said housing, said opening being dimensioned to permit unimpeded insertion of a portion of said conductor into said pocket;

a contact element mounted within said housing, said contact element including a terminal portion to electrically engage said portion of said conductor;

means mounted on said housing and operable from the exterior of said housing for driving said conductor into electrical engagement with said contact terminal portion; and conductor strain relief means cooperating with said driving means for mechanically retaining said conductor in terminated position within said pocket; and cable strain relief means, operable independently of said conductor strain relief means, for preventing said cable from moving with respect to said connector.

* * * * *